United States Patent [19]

Clarke

[11] Patent Number: 4,617,947

[45] Date of Patent: Oct. 21, 1986

[54] CHIN SUPPORT BELT

[76] Inventor: Mary A. Clarke, 28887 Ave 15 1/2, Madera, Calif. 93638

[21] Appl. No.: 650,281

[22] Filed: Sep. 12, 1984

[51] Int. Cl.[4] ..... A45D 44/00

[52] U.S. Cl. ..... 132/1 R; 132/9

[58] Field of Search ..... 132/9; 128/DIG. 23, 128/76 R, 98

[56] References Cited

U.S. PATENT DOCUMENTS

| | | | |
|---|---|---|---|
| 3,964,474 | 6/1976 | Fox | 128/DIG. 23 |
| 4,205,667 | 6/1980 | Gaylord | 128/DIG. 23 |
| 4,215,709 | 8/1980 | Carr | 132/9 |
| 4,219,193 | 8/1980 | Newman | 128/DIG. 23 |
| 4,259,566 | 3/1981 | Kobayashi | 132/9 |

*Primary Examiner*—Gregory E. McNeill

*Attorney, Agent, or Firm*—Limbach, Limbach & Sutton

[57] ABSTRACT

An apparatus for supporting the chin of subject suspended from a hooded hair dryer is disclosed. The apparatus is comprised of an elongated member of a flexible material having a pair of spaced apart protrusions of a flexible resilient material, such as a foam rubber. The protrusions are separated by a distance roughly corresponding to the width of the subject's chin. In operation, the apparatus is suspended from the hood of the hair dryer to allow adjustments of the apparatus about the head of the subject.

9 Claims, 4 Drawing Figures

CHIN SUPPORT BELT

TECHNICAL FIELD

The present invention relates generally to an apparatus for supporting the chin of a subject and more specifically to a belt to be suspended from a hooded hair dryer to comfortably support a subject's chin while the subject nods or sleeps so that the subject's head remains safely under the dryer hood and the drying process is not interrupted.

BACKROUND OF THE INVENTION

Hair dryers are generally of two basic types: portable hand-held models and large, rigid hooded models. Hooded hair dryers have been in use for a number of years. They are generally comprised of a hollow dome-shaped structure with multiple perforations in the inner wall of the chamber within the dome. Air is passed through the device and enters the chamber through the perforations. In use, the subject is placed such that at least a portion of his or her head is enclosed within the inner chamber. Thus the air flowing into the chamber promotes evaporation of water on the subject's head and hence drying the subject's wet hair. Such devices typically include means to heat the air entering the chamber such that the evaporation/drying process is further enhanced.

These devices have proved useful on the commercial as well as on the individual home use level because, unlike their hand-held counterparts, they do not require that the operator stand guard over the drying process. Rather, these hooded devices merely require the operator to set the dryer to the desired setting and periodically check the progress of the drying process. The elimination of the need for the operator's constant attention provides the operator with freedom to perform other tasks.

Despite the above listed advantages, however, it has been discovered that the subject who sits with his or her head under such a device for a prolonged period of time experiences drosiness and often falls asleep during the drying process. As can be appreciated, the sleeping subject's head often falls forward or to the side and may hit the inner wall of the domed chamber. The repercussions of such an occurrence are not limited simply to interruption of the drying process but include those of a more serious variety ranging from discomfort due to a sudden awakening to a serious head injury.

It is, therefore, an object of the present invention to provide an apparatus for comfortably supporting a subject's chin when using a device which encloses at least a portion of the subject's head area.

It is a further object of the present invention to provide an apparatus for supporting a subject's chin when using a hood type hair dryer.

SUMMARY OF THE INVENTION

An apparatus for supporting a subject's chin when using a device which encloses at least a portion of the subject's head area is disclosed comprising an elongated member of a substantially flexible material having a pair of spaced apart protrusions separated by a distance substantially corresponding to the width of the subject's chin and means for suspending the apparatus from the head-enclosing device. In use, the apparatus is detachably suspended from the head-enclosing device such as to facilitate placing the subject's head within the device and to allow adjustments of the fit of the apparatus about the subject.

The invention is described below in greater detail with reference to the accompanying drawings which depict different views of an apparatus of the present invention.

BEST MODE FOR CARRYING OUT THE INVENTION

Figure 3:
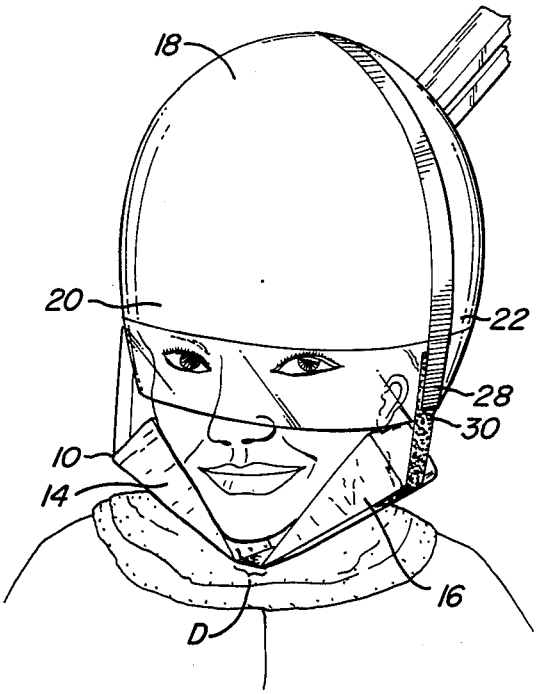
FIG. 3 is front perspective view of a second embodiment of the present invention in the operational position.
Figure 1:
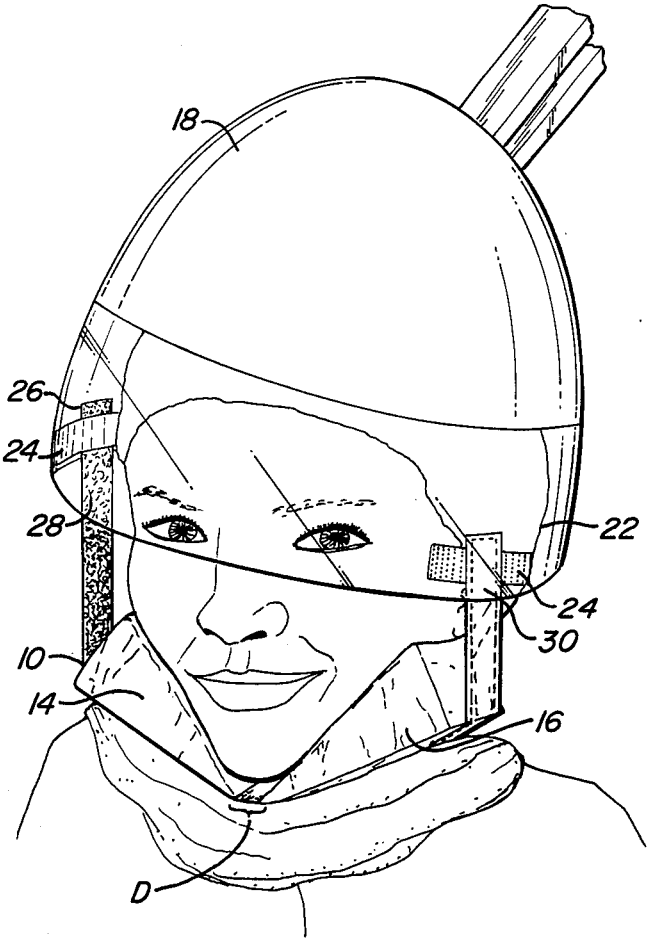
FIG. 1 is a front perspective view of a first embodiment of the present invention in the operational position.
Figure 2A:
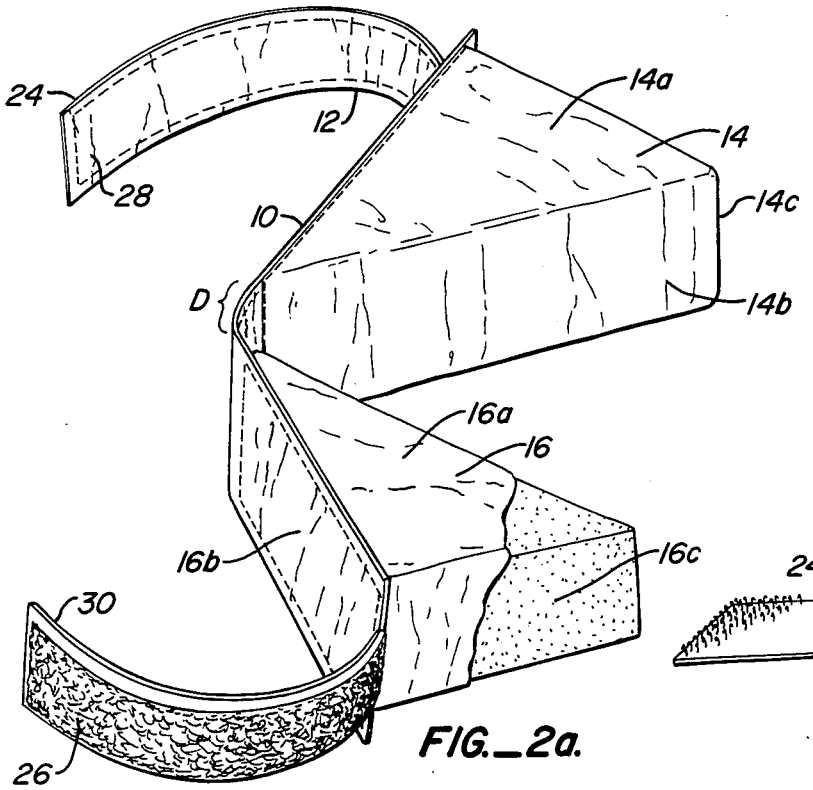
FIG. 2*a* is a side elevational view of an apparatus of the present invention.
Figure 2B:
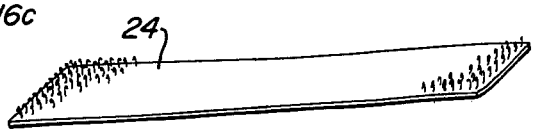
FIG. 2*b* is a side elevational view of material 24.

In the drawings, an emobodiment of the present invention is shown generally as reference number 10. As shown in FIG. 2, the apparatus is comprised of an elongated member 12 of a flexible material having a pair of protrusions 14 and 16. Each protrusions may have a triangular cross-sectional area 14*a* or 16*a* in one plane and rectangular cross-sectional areas 14*b* and 14*c* or 16*b* and 14*c* in the other two planes. Referring to FIGS. 1 and 3, protrusions 14 and 16 should be spaced apart by a distance D which generally corresponds to the width of a subject's chin.

In operation, the apparatus is suspended from a device 18 which encloses at least a portion of the subject's head area, such as a helmut and, particularly, a hood-type hair dryer. The apparatus should fit about the subject's head such that the chin rests snugly in D but comfortably between protrusions 14 and 16 so as to provide adequate support for the position of the subject's head. As shown in FIG. 2, protrusion 16 may be comprised of a flexible resilient material, such as a foam rubber. Protrusion 14 is similarly comprised of a flexible resilient material. This arrangement of flexible resilient protrusions functions to further insure a comfortable fit about the subject's head by providing a cushioned support for the chin and jaw.

Referring now to FIG. 1, the apparatus may be suspended from the periphery of the hood 18 at points 20 and 22 near the subject's temple regions. To facilitate the suspension of the apparatus, a first material 24 may be attached to the hood and a second material 26 attached to the opposite ends 28 and 30 of elongated member 12. In this embodiment, the first material must be capable of detachably attaching to the second material. Fabrics of the type known as Velcro have proven useful for this purpose. Further, the first material may be placed onto the hood perpendicularly in relation to the elongated member. This relative arrangement of materials allows for vertical and horizontal adjustment of the position of the apparatus about the subject's head by attaching the first and second materials at various positions along their respective lengths.

FIG. 3 illustrates another embodiment of the present invention in which the apparatus is suspended from the hood by extending the apparatus over the top of hood 18. In this illustrated embodiment, ends 28 and 30 of elongated member 12 may be detachably attached to one another. This may be accomplished by attaching a first and second material, which are capable of detachably attaching to one another, such as Velcro, to ends 28 and 30 respectively. Thus, the apparatus may be extended around the hood and the subject's head and held in place by attaching end 28 to end 30.

As illustrated in FIGS. 1 and 3, the apparatus functions to restrict the movement of the subject's head and, thus, allows the subject to sit under the hood, nod and even fall asleep without fear that his or her head will hit the hood.

Although the foregoing invention has been described in some detail by way of illustration and example for purposes of clarity of understanding, it will be obvious that certain changes and modifications may be practiced within the scope of the appended claims. For example, protrusions 14 and 16 between which the subject's chin rests need not have triangular and rectangular cross sectional areas as disclosed herein. These cross-sections may be of any desirable configuration provided that they provide a suitable support for enclosing the area which supports the subject's chin.

I claim:

1. An apparatus for supporting the chin of a subject of the type to be suspended from a unit located above the subject's chin, said apparatus comprising:

an elongated member comprised of a substantially flexible material having a pair of spaced apart tapered protrusions, each of said protrusions having a narrow end and a wide end and arranged along said elongated member such that the narrow ends are proximal to one another and separated by a distance substantially corresponding to the width of the subject's chin; and means for suspending said elongated member from the unit.

2. A chin support apparatus according to claim 1 wherein said device enclosing at least a portion of the subject's head area is the hood portion of a hood-type hair dryer.

3. A chin support apparatus according to claim 1 wherein said protrusions are comprised of a substantially flexible resilient material.

4. A chin support apparatus according to claim 3 wherein said flexible resilient material is a foam rubber.

5. A chin support apparatus according to claim 1 wherein said protrusions have a substantially triangular cross-sectional area in a first plane and substantially rectangular cross-sectional areas in a second and a third plane.

6. A chin support apparatus according to claim 1 wherein said suspending means includes connecting the opposite ends of said apparatus to the device.

7. A chin support apparatus according to claim 6 wherein the opposite ends of said elongated member are connected to the device by attaching:

a first material to the opposite ends said elongated member; and a second material to the device wherein said first and second materials are capable of being detachably attached to one another.

8. An apparatus for supporting the chin of a subject of the type to be suspended from a device enclosing at least a portion of the subject's head area, said apparatus comprising an elongated member having a substantially flexible material with a pair of spaced apart protrusions, wherein said protrusions are separated by a distance substantially corresponding to the width of the subject's chin with each protrusion having a substantially flexible resilient material configured with a substantially triangular cross sectional area in a first plane and substantially rectangular cross sectional areas in a second and third plane.

9. A chin support apparatus according to claim 8 wherein said device enclosing at least a portion of the subject's head area is the hood portion of a hood-type hair dryer.

* * * * *